US007310824B2

(12) United States Patent
Walsh

(10) Patent No.: US 7,310,824 B2
(45) Date of Patent: Dec. 25, 2007

(54) GARMENT WITH HYDROPHOBIC FOREARMS

(75) Inventor: Kenneth C. Walsh, Bozeman, MT (US)

(73) Assignee: Simms Fishing Products LLC, Bozeman, MT (US)

( * ) Notice: Subject to any disclaimer, the term of this patent is extended or adjusted under 35 U.S.C. 154(b) by 301 days.

(21) Appl. No.: 10/936,334

(22) Filed: Sep. 8, 2004

(65) Prior Publication Data

US 2006/0048263 A1 Mar. 9, 2006

(51) Int. Cl.
*A41B 1/08* (2006.01)

(52) U.S. Cl. ..... 2/122; 2/125; 2/69

(58) Field of Classification Search ..... 2/69, 2/85, 87, 93, 102, 115, 122
See application file for complete search history.

(56) References Cited

U.S. PATENT DOCUMENTS

| | | | | |
|---|---|---|---|---|
| 3,922,723 | A | 12/1975 | Popper | |
| 5,416,929 | A | 5/1995 | Braunstein | |
| 5,453,268 | A | 9/1995 | Ueno et al. | |
| 5,526,532 | A * | 6/1996 | Willard | 2/69 |
| 5,631,074 | A * | 5/1997 | Herlihy, Jr. | 442/35 |
| 5,829,060 | A * | 11/1998 | Falk et al. | 2/102 |
| 5,946,726 | A | 9/1999 | Green | |
| 6,000,057 | A | 12/1999 | Newman | |
| 6,040,251 | A | 3/2000 | Caldwell | |
| 6,041,446 | A | 3/2000 | Braunstein et al. | |
| 6,155,084 | A | 12/2000 | Andrews et al. | |
| 6,194,332 | B1 | 2/2001 | Rock et al. | |
| 6,427,242 | B1 | 8/2002 | Bush et al. | |
| 6,438,755 | B1 | 8/2002 | MacDonald et al. | |
| 6,499,320 | B1 | 12/2002 | Bernhardt | |
| RE38,497 | E * | 4/2004 | Falk et al. | 2/94 |
| 2002/0023283 | A1 | 2/2002 | Kania et al. | |
| 2002/0124293 | A1 | 9/2002 | Zeiler | |
| 2002/0146950 | A1 | 10/2002 | Reich | |
| 2002/0162161 | A1 | 11/2002 | Zeiler | |
| 2003/0106130 | A1 | 6/2003 | Reynolds | |

* cited by examiner

*Primary Examiner*—Gary L. Welch
*Assistant Examiner*—Andrew W Sutton
(74) *Attorney, Agent, or Firm*—Antoinette M. Tease

(57) ABSTRACT

A garment comprising different portions having different performance characteristics. A preferred embodiment is a fishing shirt comprising: a body portion, said body portion being fabricated from a breathable, knitted fabric having a wicking finish; a collar portion and a yoke portion, said collar portion and said yoke portion being fabricated from a four-way stretch fabric having a wicking finish; a pair of lower sleeve portions, each of said lower sleeve portions being fabricated from a non-wicking, hydrophobic fabric; and a pair of underarm portions, each of said underarm portions being fabricated from a knit, anti-microbial fabric.

15 Claims, 2 Drawing Sheets

GARMENT WITH HYDROPHOBIC FOREARMS

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to a garment that comprises a plurality of fabric types having different performance characteristics in different areas of the garment. In particular, the invention relates to a garment having a hydrophobic forearm.

Fishing, and particularly fly fishing, imposes a wide variety of performance requirements on the garments of the fisherman. For example, a fly fishing shirt is most comfortable when moisture does not accumulate on the skin of the fisherman, when the shirt does not impede the movement of the fisherman's upper body and arms, when the shirt does not support the growth of odor-producing microorganisms, and when dipping a forearm into the water (e.g., to release a fish) does not result in the other parts of the garment becoming wet. Background art fly fishing garments have not adequately addressed these requirements.

The background art is characterized by U.S. Pat. Nos. 3,922,723; 5,416,929; 5,453,268; 5,631,074; 5,453,268; 6,041,446; 5,946,726; 6,000,057; 6,040,251; 6,155,084; 6,194,332; 6,427,242; 6,438,755; and 6,499,320; and U.S. patent applications Nos. 2002/0023283; 2002/0124293; 2002/0146950; 2002/0162161; and 2003/0106130; the disclosures of which patents and patent applications are incorporated by reference as if fully set forth herein.

Popper in U.S. Pat. No. 3,922,723 discloses methods and articles for deodorizing using ion exchange cotton. This invention is limited in that a garment must be treated with a weak base anion exchange material.

Braunstein in U.S. Pat. No. 5,416,929 discloses a garment having an antimicrobial treated crotch. This invention is limited in that an open knit construction that is formed of both treated and untreated yarn must be used, with the treated yam being treated with a chlorinated phenoxy antimicrobial compound.

Ueno et al. in U.S. Pat. No. 5,453,268 discloses an antimicrobial and deodorant-finished product. This invention is limited in that it requires use of an antimicrobial Schiff base derivative of an aminoglycoside as the active ingredient and a polyoxy-ethylenepolyalkylsiloxane for improving resistance to washing.

Herlihy, Jr. in U.S. Pat. No. 5,631,074 discloses a waterproof breathable fabric for outdoor athletic apparel. This invention is limited in that it is a laminated fabric that has uniform performance characteristics.

Green in U.S. Pat. No. 5,946,726 discloses a sport top with interior bust support. This invention is limited in that it requires incorporation of a bust support structure into a garment.

Newman in U.S. Pat. No. 6,000,057 discloses odor preventing hunting apparel. This invention is limited in that it requires the use of an inner layer of antimicrobial fabric and an outer layer of an odor absorbing material.

Caldwell in U.S. Pat. No. 6,040,251 discloses garments of barrier webs. This invention is limited in that it is a fabric comprising a web that has been treated with a curable shear thinned thixotropic polymer composition.

Braunstein in U.S. Pat. No. 6,041,446 discloses a panty with an integrated treated crotch. This invention is limited in that it comprises a garment having a portion that is treated with a chlorinated phenoxy antimicrobial composition.

Andrews et al. in U.S. Pat. No. 6,155,084 disclose a protective article made of a composite fabric. This invention is limited in that use of yams or materials having different mechanical properties is required.

Bush et al. in U.S. Pat. No. 6,427,242 disclose a winter-sports garment lining system characterized by localized climate control characteristics. At col. 4, lines 2-6, this reference teaches that "the sleeves of the garment lining may include a nylon or other water-resistant fabric, as may be an area of the garment lining adjacent to the zipper or other principal closure mechanism of the garment; here again to prevent wetting of the lining and any underlying apparel." The invention is limited, however, in that the disclosed structure does not prevent water into which a lower sleeve of the garment is immersed (e.g., during fly fishing operations) from being transported into adjacent portions of the garment. At col. 1, lines 31-34, the reference discloses "a garment lining system that is specifically configured to provide desired performance properties at predetermined anatomical locations rather than universally throughout the garment lining." The reference does not teach the fabric-type/location combinations disclosed herein. Moreover, the requirement that a stretchable open mesh sheet be used in the armpit region (col. 4, lines 40-43) teaches away from the invention disclosed herein.

MacDonald et al. in U.S. Pat. No. 6,438,755 disclose an aerodynamic garment for improved athletic performance. This invention is limited in that requires the use of fabrics appropriate for the Reynolds numbers of body segments.

Bernhardt in U.S. Pat. No. 6,499,320 discloses a garment having antimicrobial properties. This invention is limited in that the presence of yarns with the active antimicrobial agent on the interior of the garment is required. Moreover, a fabric that has uniform performance characteristics is disclosed.

Kania et al. in U.S. patent application No. 2002/0023283 disclose apparel designed to be worn in or under water. This invention is limited in that molding of the article of apparel is required.

Zeiler in U.S. patent application No. 2002/0124293 discloses an insect barrier garment. This invention is limited in that a base fabric, a spacer layer and a cover fabric are required.

Reich in U.S. patent application No. 2002/0146950 discloses antimicrobial materials. This invention is limited in a fabric having uniform performance characteristics is required.

Zeiler in U.S. patent application No. 2002/0162161 discloses an insect barrier garment. This invention is limited in that a base fabric, a spacer layer and a cover fabric are required.

Reynolds in U.S. patent application 2003/0106130 discloses a body form-fitting rainwear. This invention is limited in a layered fabric having uniform performance characteristics is required.

From the above, it is apparent that what is needed is a garment that is specifically designed for fishing in general and for fly fishing in particular. A garment is needed that comprises different portions having different performance characteristics that meet the performance requirements of fly fishing.

BRIEF SUMMARY OF THE INVENTION

The purpose of the invention is to provide a comfortable garment to wear while fishing. One advantage of a preferred embodiment of the invention is that the body portion is breathable, wicks the fly fisherman's perspiration away from his or her torso and is capable of stretching in two directions to allow unimpeded movement during fishing. Yet another advantage of preferred embodiments of the invention is that the collar portion and the yoke portion are stretchable in two dimensions and wick the fisherman's perspiration away from his/her shoulders, upper arms and neck. Another advantage of preferred embodiments of the invention is that lower sleeve portions of the garment resist absorption of water to which they are exposed and resist transmission of any water that they do absorb to adjacent portions of the garment. Yet another advantage of preferred embodiments of the invention is that the material from which the underarm portions are fabricated wicks the fisherman's perspiration away from his/her underarms and neutralizes odor-causing bacteria to which it is exposed.

One object of preferred embodiments of the invention is to facilitate the movements of fly fishing. Another object of preferred embodiments of the invention is to prevent water into which the lower sleeves of the garment may be dipped from accumulating in the garment and being transmitted to other portions of the garment. Yet another object of preferred embodiments of the invention is to kill bacteria to which the underarm portions of the garment are exposed.

The invention is a garment comprising different portions having different performance characteristics. In a preferred embodiment, the garment comprises a body portion, a collar portion having a neck opening, a yoke portion, a pair of lower sleeve portions, a pair of underarm portions and a zipper. Preferably, the portions of the garment are joined by sewing or other conventional processes. In use, the invention is operated by simply by wearing it.

In a preferred embodiment, the invention is a fishing shirt comprising: a body portion, said body portion being fabricated from a breathable, knitted fabric comprising polyester fibers and having a wicking finish; a collar portion and a yoke portion, said collar portion and said yoke portion being fabricated from a four-way stretch fabric having a wicking finish; a pair of lower sleeve portions, each of said lower sleeve portions being fabricated from a non-wicking, hydrophobic fabric comprising about 88 percent polypropylene fibers and about 12 percent elastane fibers; and a pair of underarm portions, each of said underarm portions being fabricated from a knit, anti-microbial fabric that comprises polyester fibers and silver-plated nylon fibers.

In another preferred embodiment, the invention is a garment comprising: a body portion, said body portion being fabricated from a breathable fabric having a wicking finish; a yoke portion, said yoke portion being fabricated from a four-way stretch fabric having a wicking finish; a pair of lower sleeve portions, each of said lower sleeve portions being fabricated from a non-wicking, hydrophobic fabric; and a pair of underarm portions, each of said underarm portions being fabricated from an anti-microbial fabric. Preferably, each of said fabrics is a knitted fabric or a woven fabric. Preferably, said breathable fabric comprises polyester fibers. Preferably, said non-wicking, hydrophobic fabric comprises polypropylene fibers and elastane fibers. Preferably, said anti-microbial fabric comprises a first, inner layer that is hydrophilic combined in a plaited construction with a second, outer layer that is moisture absorbent in a plaited construction, said second, outer layer preferably comprising fibers that are either embedded with silver or copper sulfide or coated with silver or copper sulfide. Alternatively, said anti-microbial fabric comprises an anti-microbial agent that is applied to the fabric as a finish.

In another preferred embodiment, the invention is a garment comprising: a torso portion having a neck opening, said torso portion being fabricated from a knitted fabric, a woven fabric or a non-woven fabric; a pair of sleeve portions, each of said sleeve portions comprising an upper arm portion and a forearm portion, said forearm portion being fabricated from a non-wicking, hydrophobic fabric; and a pair of underarm portions, each of said underarm portions being fabricated from a knit fabric that comprises silver-bonded fibers.

In yet another preferred embodiment, the invention is a composite garment comprising: a body portion having a neck opening, said body portion being fabricated from a fabric that is capable of stretching in two directions; a pair of sleeve portions, each of said sleeve portions comprising an upper arm portion and a cuff portion, said upper arm portion being capable of stretching along its length and said cuff portion being fabricated from a non-wicking, water-resistant fabric; and a pair of underarm portions, each of said underarm portions being fabricated from a bi-component knit fabric that comprises silver-bonded fibers. Preferably, the non-wicking, water-resistant fabric is comprised of polypropylene fibers and elastane fibers.

In another preferred embodiment, the invention is a shirt for a fisherman, said shirt comprising: means for covering the torso of the fisherman (e.g., a body portion), said means for covering the torso of the fisherman being breathable and wicking the fisherman's perspiration away from his torso; means for covering the shoulders, upper arms and a portion of the neck of the fisherman (e.g., yoke portion and shoulder-upper arm portions), said means for covering the shoulders, upper arms and a portion of the neck of the fisherman being stretchable in two dimensions and wicking the fisherman's perspiration away from his shoulders upper arms and the portion of his neck; and means for covering the lower arms of the fisherman (e.g., lower sleeve portions), said means for covering the lower arms of the fisherman being hydrophobic and preventing water to which it is exposed from wicking into said means for covering the shoulders, upper arms and a portion of the neck of the fisherman; and means for covering the underarms of the fisherman (e.g., underarm portions), said means for covering the underarms of the fisherman wicking the fisherman's perspiration away from his underarms and neutralizing odor-causing bacteria to which it is exposed. Preferably, said means for covering the torso of the fisherman comprises a breathable, knitted fabric comprising polyester fibers and having a wicking finish. Preferably, said means for covering the shoulders, upper arms and a portion of the neck of the fisherman comprises a four-way stretch fabric having a wicking finish. Preferably, said means for covering the underarms of the fisherman comprises a non-wicking, quick-drying hydrophobic fabric comprising about 88 percent polypropylene fibers and about 12 percent elastane fibers. Alternatively, said means for covering the underarms of the fisherman comprises a fabric comprising a fiber selected from the group consisting of: a polyester fiber, a nylon fiber and a natural fiber treated with a durable water repellant. Preferably, said means for covering the underarms of the fisherman comprises an antimicrobial fabric. Preferably, said anti-microbial fabric comprises a first, inner layer that is hydrophilic combined in a plaited construction with a second, outer layer that is moisture absorbent in a plaited construction, said second, outer layer preferably comprising fibers that are either embedded with silver or copper sulfide or coated with silver or copper sulfide.

In another preferred embodiment, the invention is a garment comprising: a body portion, said body portion being fabricated from a breathable fabric; a yoke portion, said yoke portion being fabricated from a stretch fabric; a pair of lower sleeve portions, each of said lower sleeve portions being fabricated from a hydrophobic fabric; and a pair of underarm portions, each of said underarm portions being fabricated from an anti-microbial fabric. Preferably, each of said fabrics is a knitted fabric. Preferably said breathable fabric comprises polyester fibers. Preferably, said hydrophobic fabric comprises polypropylene fibers and elastane fibers. Preferably, said anti-microbial fabric comprises a first, inner layer and a second, outer layer that is moisture absorbent, said second, outer layer preferably comprising fibers that are either embedded with silver or copper sulfide or coated with silver or copper sulfide. Alternatively, said anti-microbial fabric comprises an anti-microbial agent that is applied to the fabric as a finish.

Further aspects of the invention will become apparent from consideration of the drawings and the ensuing description of preferred embodiments of the invention. A person skilled in the art will realize that other embodiments of the invention are possible and that the details of the invention can be modified in a number of respects, all without departing from the concept. Thus, the following drawings and description are to be regarded as illustrative in nature and not restrictive.

BRIEF DESCRIPTION OF THE SEVERAL VIEWS OF THE DRAWINGS

The features of the invention will be better understood by reference to the accompanying drawings which illustrate presently preferred embodiments of the invention. In the drawings.

Figure 1:
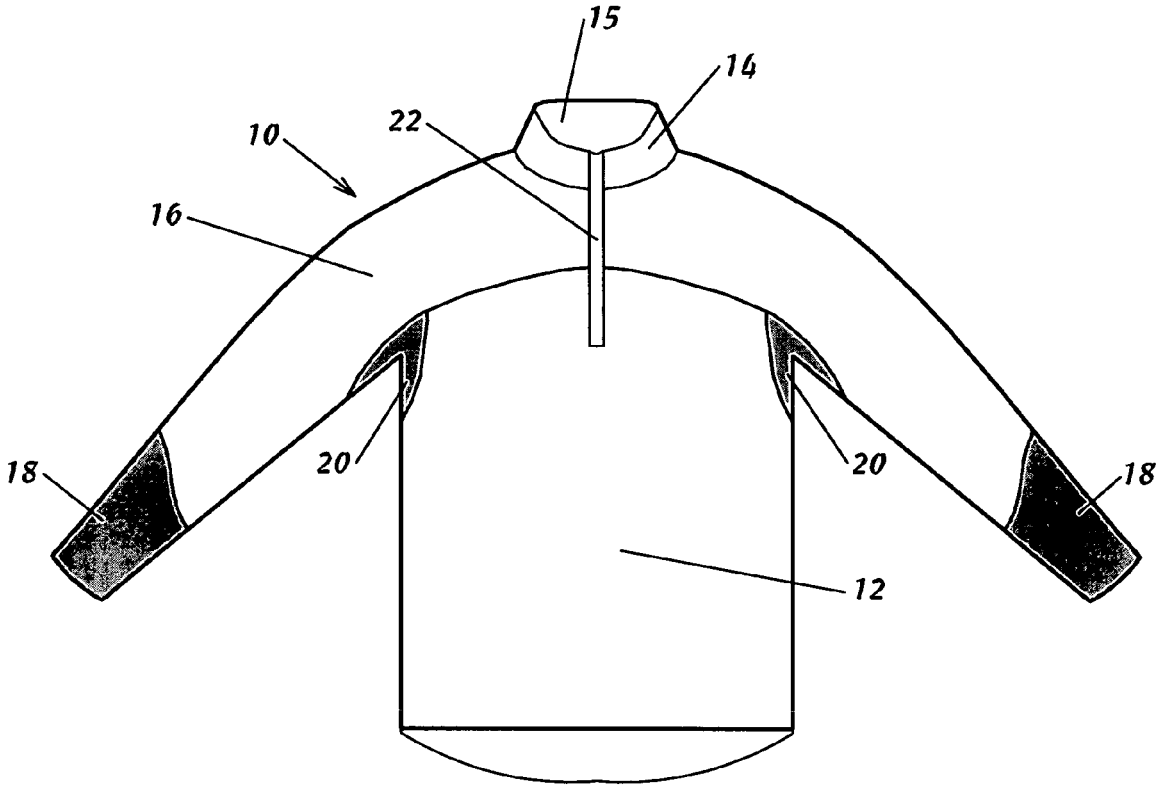
FIG. 1 is a front elevation view of a preferred embodiment of the invention.

The following reference numerals are used to indicate the parts and environment of the invention the drawings:

10 fishing shirt, garment
12 body portion, torso portion, body
14 collar portion, collar
15 neck opening
16 yoke portion
18 lower sleeve portions, cuffs
20 underarm portions, armpit gussets
22 zipper

DETAILED DESCRIPTION OF THE INVENTION

Figure 2:
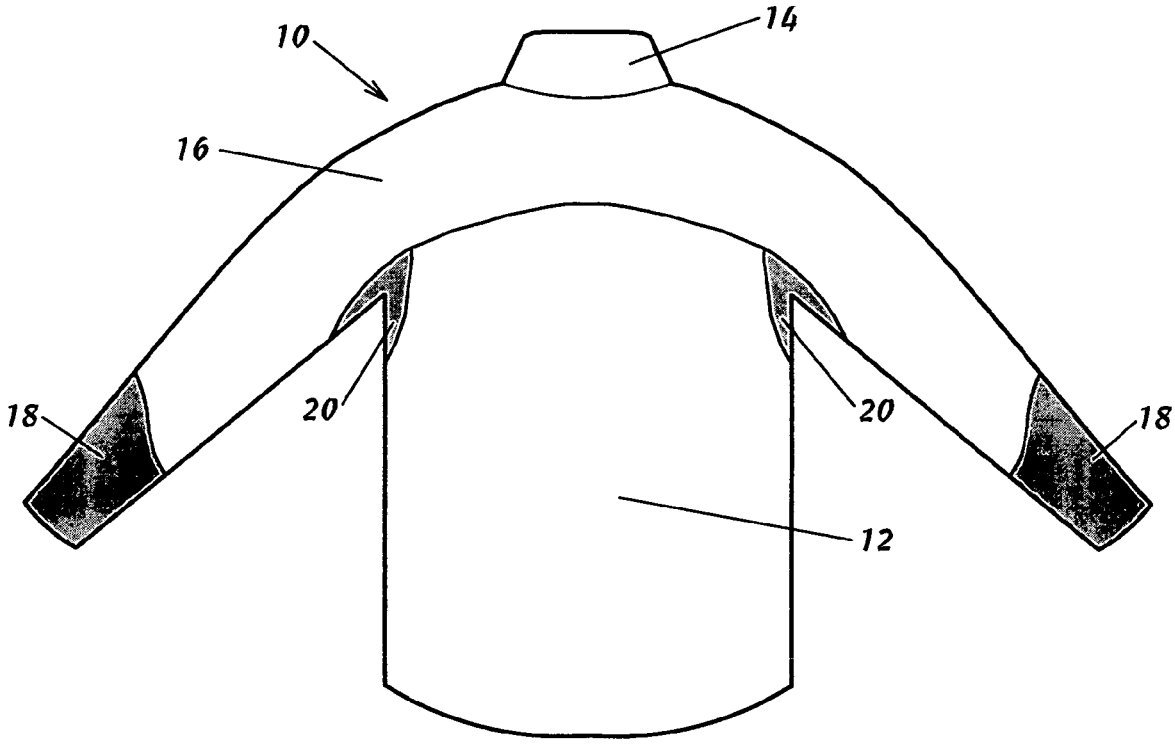
FIG. 2 is a back elevation view of the preferred embodiment of the invention also illustrated in FIG. 1.

Referring to FIGS. 1 and 2, a preferred embodiment of fishing shirt 10 is illustrated. In this embodiment, fishing shirt 10 comprises body portion 12, collar portion 14 having neck opening 15, yoke portion 16, a pair of lower sleeve portions 18, a pair of underarm portions 20 and zipper 22. Preferably, portions 12-20 are joined by sewing or other conventional processes. Any one or more of said portions is preferably fabricated from a knitted fabric or a woven fabric.

In a preferred embodiment, body portion 12 is fabricated from a breathable, knitted fabric comprising polyester fibers and having a wicking finish. More preferably, body portion 12 is fabricated from Style No. 7319 fabric from Malden Mills of Lawrence, Mass. Alternative fabrics from which body portion could be fabricated include fabrics comprised of the following materials or combinations of materials: polyester/LYCRA®, nylon, nylon/LYCRA®, cotton, cotton/LYCRA®, polyester/nylon, polyester/nylon/LYCRA®, cotton/nylon, cotton/nylon/LYCRA®, polyester/cotton, polyester/cotton/LYCRA®, wool, wool/nylon, wool/nylon/LYCRA®, wool/polyester, wool/polyester/LYCRA®, wool/LYCRA®, polypropylene, polypropylene/LYCRA®, polypropylene/wool, polypropylene/wool/LYCRA®, acetate, acetate/nylon, acetate/nylon/LYCRA®, acetate/polyester, acetate/polyester/LYCRA®, acetate/wool, acetate/wool/LYCRA®, silk, Poly/Lactic/Acid (PLA) from Dow/Cargill, which forms a polyester-like fiber and is derived from the corn plant, and variations in construction of the above mentioned textiles including stretch and non-stretch fabrics, and woven constructions.

In a preferred embodiment, collar portion 14 and yoke portion 16 are fabricated from a four-way stretch fabric having a wicking finish, e.g., Style No. 7304 fabric from Malden Mills of Lawrence, Mass. Alternative fabrics from which collar portion 14 and yoke portion 16 could be fabricated include fabrics comprised of the following materials or combinations of materials: polyester/LYCRA®, nylon, nylon/LYCRA®, cotton, cotton/LYCRA®, polyester/nylon, polyester/nylon/LYCRA®, cotton/nylon, cotton/nylon/LYCRA®, polyester/cotton, polyester/cotton/LYCRA®, wool, wool/nylon, wool/nylon/LYCRA®, wool/polyester, wool/polyester/LYCRA®, wool/LYCRA®, polypropylene, polypropylene/LYCRA®, polypropylene/wool, polypropylene/wool/LYCRA®, acetate, acetate/nylon, acetate/nylon/LYCRA®, acetate/polyester, acetate/polyester/LYCRA®, acetate/wool, acetate/wool/LYCRA®, silk, PLA, and variations in construction of the above mentioned textiles including stretch and non-stretch fabrics, and woven constructions.

In a preferred embodiment, lower sleeve portions 18 are fabricated from a non-wicking, hydrophobic fabric comprising about 88 percent polypropylene fibers and about 12 percent elastane fibers, e.g., Style No. 3077-22 fabric from Deer Creek of Stamford, Conn. Preferred elastane fibers are LYCRA® brand stretch fibers from INVISTA of Wilmington, Del. Alternative fabrics from which lower sleeve portions 18 could be fabricated include fabrics comprised of the following materials or combinations of materials: polyester/LYCRA®, nylon, nylon/LYCRA®, cotton, cotton/LYCRA®, polyester/nylon, polyester/nylon/LYCRA®, cotton/nylon, cotton/nylon/LYCRA®, polyester/cotton, polyester/cotton/LYCRA®, wool, wool/nylon, wool/nylon/LYCRA®, wool/polyester, wool/polyester/LYCRAS, wool/LYCRA®, polypropylene, polypropylene/LYCRA®, polypropylene/wool, polypropylene/wool/LYCRA®, acetate, acetate/nylon, acetate/nylon/LYCRA®, acetate/polyester, acetate/polyester/LYCRA®, acetate/wool, acetate/wool/LYCRA®, silk, PLA, and variations in construction of the above mentioned textiles including stretch and non-stretch fabrics, and woven constructions, specially those treated for a durable and high level of water-repellancy. Alternative fibers from which lower sleeve portions 18 could be fabricated include PLA, polyester, nylon and natural fibers treated with Durable Water Repellant from Dupont, 3M, Grangers, Mitsubishi Chemical, or another manufacturer. Another water-repellancy product appropriate for use in fabricating lower sleeve portion 18 is REVIVEX® water repellent which once was sold by W. L. Gore, and is now manufactured and sold by the McNett Corp.

In a preferred embodiment, underarm portions 20 are fabricated from a knit, anti-microbial fabric that comprises polyester fibers and silver-plated nylon fibers. A preferred fabric for underarm portions 20 is POLARTEC® POWDER DRY® brand fabric with X-STATIC® brand fiber (Style No. 9011) from Malden Mills Industries, Inc. of Lawrence, Mass. POLARTEC® POWDER DRY® brand fabric with X-STATIC® brand fiber embodies the invention disclosed in U.S. Pat. No. 6,194,332, which disclosure is incorporated herein as if fully set forth. U.S. Pat. No. 6,194,332 teaches that preferred embodiments of fabrics that could be used for lower sleeves portions 18 comprise a first, inner layer that is hydrophilic that is combined with a second, outer layer that is moisture absorbent in a plaited construction. The second, outer layer preferably comprises fibers that are either embedded with silver or copper sulfide or coated with silver or copper sulfide.

Alternative fabrics that contain silver from which from which underarm portions 20 could be fabricated include VISAENDURANCE™ brand fabric by Milliken & Company of Spartanburg, S.C. and fabric fabricated from A.M.Y.™ brand yarn from Unifi Inc. of Greensboro, N.C. Other alternative fabrics from which underarm portions 20 could be fabricated comprise other metallic products., e.g., copper. Alternatively, the fabric from which underarm portions 20 is fabricated is treated with AEgis antimicrobial fabric finish from AEGIS Environmental Management, Inc. of Midland, Mich.; triclosan ($Cl_2H_7Cl_3O_2$) applied as a fabric finish; or another anti-microbial agent that is known in the art.

Polymers are the foundation of all synthetic fibers. Fishing shirt 10 is preferably made of 100 percent synthetic polymers (e.g., polyester, polypropylene, nylon and LYCRA® polymers). The physical properties of these materials, such as strength, light weight, quick drying, moisture wicking, etc., are superior to those of natural fibers.

Fiber is the lowest common denominator of all fabrics. Fibers are short lengths of fiber that are either naturally occurring (e.g., cotton, wool), partially synthesized (e.g., rayon, acetate) or derived from polymers (e.g., nylon, polyester, polypropylene). Fibers are chosen for their physical properties that translate into functional characteristics of the finished fabric. The primary factors in fiber selection are determined by the end use requirements of the finished product. Polypropylene is preferably incorporated into fishing shirt 10 because of its extremely low moisture retaining property. Color in polypropylene is imparted when the fiber is manufactured.

Fibers are spun into yarn via different spinning processes such as ring spinning, air jet spinning, open end spinning, etc. Filament yams are made from continuous strands of synthetic polymer and can be left in a flat or hard configuration or can be textured via various processes to provide bulk and/or stretch. Fishing shirt 10 preferably incorporates a combination of spun and filament yarns.

Fabrics may be woven, knitted or non-woven. Woven and knitted fabrics use yam in various manufacturing processes to form fabric. Non-woven fabrics use fiber to form fabric, thereby omitting the yam stage. Knitted fabrics are preferably exclusively incorporated into fishing shirt 10, primarily because of their stretchability, softness, drapeability, warmth and breathability.

The final stages of fabric preparation are dyeing and finishing. Dyeing is the step in which color is imparted onto the cloth where it does not already exist. Finishing is the step in which chemicals and processes are used to impart aesthetic and functional attributes to a fabric that are not inherently present via the raw materials being used. The polyester incorporated into preferred embodiments of fishing shirt 10 is preferably dyed using disperse dyes, while the polypropylene incorporated into preferred embodiments of fishing shirt 10 is preferably dyed at the fiber formation stage. LYCRA® fiber does not accept dye. The fabric preferably used in underarms portions 20 of fishing shirt 10 has a proprietary finish that inhibits the growth of odor causing bacteria. The fabric preferably used in body portion 12 and underarms portions 20 of fishing shirt 10 have a special finish that makes it hydrophilic (water-loving).

The material preferably used to fabricate in cuffs 18 of fishing shirt 10 is a knitted fabric made from about 88 percent polypropylene fiber and about 12 percent LYCRA® fiber. Polypropylene is an ideal polymer for this application and is especially preferred because of its inherently low moisture regain and quick drying properties. LYCRA® fiber was chosen because of its stretch and recovery characteristics.

Additional synthetic polymers that may be incorporated into the fabrics of fishing shirt 10 include PLA polyester/LYCRA®, nylon, nylon/LYCRA®, cotton, cotton/LYCRA®, polyester/nylon, polyester/nylon/LYCRA®, cotton/nylon, cotton/nylon/LYCRA®, polyester/cotton, polyester/cotton/LYCRA®, wool, wool/nylon, wool/nylon/LYCRA®, wool/polyester, wool/polyester/LYCRA®, wool/LYCRA®, polypropylene, polypropylene/LYCRA®, polypropylene/wool, polypropylene/wool/LYCRA®, acetate, acetate/nylon, acetate/nylon/LYCRA®, acetate/polyester, acetate/polyester/LYCRA®, acetate/wool, acetate/wool/LYCRA®, silk, PLA, and variations in construction of the above mentioned textiles including stretch and non-stretch fabrics, and woven constructions, specially those treated for a durable and high level of water-repellancy, and polyester. Natural fibers may also be used. While these fibers are not as preferred as polypropylene, they could be altered with special finishes such as a Durable Water Repellant to increase their hydrophobicity. Cotton could be finished in such a way as to perform in this application although the economics, durability and aesthetic values would reduced.

LYCRA® is an elastomeric yarn that is preferably incorporated into fishing some of the fabrics used in garment 10 because of an end-use application requirement that garment 10 fit snugly against the wrist while at the same time expanding when needed to fit over the hand or around the forearm when the sleeves are pulled up. Other yarns may be used instead, such as XLA from Dow Chemical Company, Reflex from Unifi, or even a standard textured polyester. LYCRA® provides the most stretch and power of recovery, but other, lesser-performing stretch yarns could also be used (or, yarn with no stretch at all).

The preferred embodiment of fishing shirt 10 uses a knitted fabric in cuffs 18 because knitted fabrics inherently provide more stretch than woven fabrics, non-woven fabrics or any variations thereof. However, fabric structures and/or constructions other than knits could be utilized if properly engineered.

The material preferably used in underarm portions 20 of fishing shirt 10 is a knitted fabric made from about 100 percent polyester fiber and less than 5 percent nylon fiber. The nylon fiber is preferably X-STATIC® fiber which is silver plated for microbial control. This finish is applied to the yarn before knitting. Silver ions from this coating are emitted by the fabric and disrupt the reproductive cycle of naturally occurring microbes. This in turn prevents the growth of additional microbes, resulting in a significant decrease in the amount of body odor caught in the fabric while wearing garment 10.

X-STATIC® fiber is preferred because it is believed to be the highest performing fiber for this particular end use application; however, alternate technologies could be utilized that would produce similar results. For example, VISAENDURANCE™ fiber contains silver ions delivered as a fabric coating to produce the same effect. A.M.Y.™ fiber from Unifi is a polyester fiber/yarn combination that uses embedded silver ions and therefore performs similarly. Methods employing technologies other than silver ions (or other metallic products) are also commercially available. For example, AEgis is a fabric finish that uses a silicone-based compound to puncture the cell walls of bacteria, thereby disrupting their reproductive cycle. Triclosan is a common chemical that is often added to fabric finishes to provide antimicrobial functions.

A person having ordinary skill in the art will recognize that there are many alternate fabric finishing technologies that could be employed in fabricating portions of fishing shirt 10. One object is to reduce to amount of odor being held by and/or emitted by preferred embodiments of garment 10. Killing microbes is one way to reduce odor, and the above-mentioned compounds are effective in this regard. Another approach is to use a scented fabric to mask the odor. Yet another approach is to use a compound similar to charcoal (e.g., activated carbon) to absorb odor. Yet another approach is to include chemicals that would actually break down or neutralize the odor itself.

While the preferred embodiment of garment 10 uses knitted fabric in armpit gussets 20, it is possible to use other fabric constructions as well, such as woven fabrics or non-woven fabrics. Furthermore, nylon or other synthetic polymers as well as natural fibers such as cotton could be substituted for the polyester fiber.

Body portion 12 of garment 10 incorporates knitted fabrics because of their ability to fit close to the body, insulate, transport moisture off of the skin, provide unrestricted movement (important for fly fishing) and dry quickly. While knitted fabrics are the most preferred fabrics for garment 10, it is possible to construct garment 10 made from primarily woven fabrics or even non-woven fabrics and provide the same benefits to the user. An alternative embodiment of fishing shirt 10 made from light, tightly woven fabrics designed to be worn as outerwear in the summer may also have underarm portions that reduce odor and have tightly fitting water-resistant cuffs 18.

Shirt 10 is advantageously worn by a fly fisherman. Shirt 10 is comfortable to wear for a number of reasons. Body portion 10 is breathable and wicks the fly fisherman's perspiration away from his/her torso. Collar portion 14 and yoke portion 16 are stretchable in two dimensions and wick the fly fisherman's perspiration away from his/her shoulders, upper arms and neck. Lower sleeve portions 18 are hydrophobic and prevent water to which they are exposed from wicking into yoke portion 16. Underarm portions 20 wick the fly fisherman's perspiration away from his/her underarms and neutralize odor-causing bacteria to which they are exposed.

From the above, it is apparent that using fabrics with different performance characteristics to fabricate different portions of fishing shirt 10 can produce many benefits. For example, using a four-way stretch fabric in yoke portion 16 (e.g., especially across the shoulders) can provide optimum flexibility and range of motion. Use of a wicking finish for yoke portion 16 and body portion 12 can add to the comfort of the wearer. Use of anti-microbial treated fabric in armpit gussets 20 is advantageous for odor control. Use of a non-wicking, quick-drying fabric in lower sleeve portions 18 provides for improved comfort because lower sleeves portions 18 can be dipped in water (to release a fish) and they will not wick water up into the upper sleeves as background art shirts will.

Many variations of the invention will occur to those skilled in the art. Some variations include garment portions (e.g., underarm portions and/or lower sleeve portions) that cover limited areas of the garment. Other variations call for garment portions that cover larger areas of the garment than are illustrated herein. All such variations are intended to be within the scope and spirit of the invention.

Although some embodiments are shown to include certain features, the applicants specifically contemplate that any feature disclosed herein may be used together or in combination with any other feature on any embodiment of the invention. It is also contemplated that any feature may be specifically excluded from any embodiment of an invention.

Sequence Listing

Not Applicable

What is claimed is:

1. A fishing shirt comprising:

a body portion, said body portion being fabricated from a breathable, knitted fabric comprising polyester fibers and having a wicking finish;

a collar portion and a yoke portion, said collar portion and said yoke portion being fabricated from a four-way stretch fabric having a wicking finish;

a pair of lower sleeve portions, each of said lower sleeve portions being fabricated from a non-wicking, quick-drying hydrophobic fabric comprising about 88 percent polypropylene fibers and about 12 percent elastane fibers; and a pair of underarm portions, each of said underarm portions being fabricated from a knit, anti-microbial fabric that comprises polyester fibers and silver-plated nylon fibers.

2. A garment comprising:

a body portion, said body portion being fabricated from a breathable fabric having a wicking finish;

a yoke portion, said yoke portion being fabricated from a four-way stretch fabric having a wicking finish;

a pair of lower sleeve portions, each of said lower sleeve portions being fabricated from a non-wicking, hydrophobic fabric; and a pair of underarm portions, each of said underarm portions being fabricated from an anti-microbial fabric.

3. The garment of claim 2 wherein each of said fabrics is a knitted fabric or a woven fabric.

4. The garment of claim 3 wherein said breathable fabric comprises polyester fibers.

5. The garment of claim 3 wherein said non-wicking, hydrophobic fabric comprises polypropylene fibers and elastane fibers.

6. The garment of claim 3 wherein said anti-microbial fabric comprises a first, inner layer that is hydrophilic combined in a plaited construction with a second, outer layer that is moisture absorbent in a plaited construction, said second, outer layer preferably comprising fibers that are either embedded with silver or copper sulfide or coated with silver or copper sulfide.

7. The garment of claim 2 wherein said anti-microbial fabric comprises an anti-microbial agent that is applied to the fabric as a finish.

8. A shirt for a fisherman, said shirt comprising:

means for covering the torso of the fisherman, said means for covering the torso of the fisherman being breathable and wicking the fisherman's perspiration away from his torso;

means for covering the shoulders, upper arms and a portion of the neck of the fisherman, said means for covering the shoulders, upper arms and a portion of the neck of the fisherman being stretchable in two dimensions and wicking the fisherman's perspiration away from his shoulders upper arms and the portion of his neck; and means for covering the lower arms of the fisherman, said means for covering the lower arms of the fisherman being hydrophobic and preventing water to which it is exposed from wicking into said means for covering the shoulders, upper arms and a portion of the neck of the fisherman; and means for covering the underarms of the fisherman, said means for covering the underarms of the fisherman wicking the fisherman's perspiration away from his underarms and neutralizing odor-causing bacteria to which it is exposed.

9. The shirt of claim 8 wherein said means for covering the torso of the fisherman comprises a breathable, knitted fabric comprising polyester fibers and having a wicking finish.

10. The shirt of claim 8 wherein said means for covering the shoulders, upper arms and a portion of the neck of the fisherman comprises a four-way stretch fabric having a wicking finish.

11. The shirt of claim 8 wherein said means for covering the underarms of the fisherman comprises a non-wicking, quick-drying hydrophobic fabric comprising about 88 percent polypropylene fibers and about 12 percent elastane fibers.

12. The shirt of claim 8 wherein said means for covering the underarms of the fisherman comprises a fabric comprising a fiber selected from the group consisting of: a polyester fiber, a nylon fiber and a natural fiber treated with a durable water repellant.

13. The shirt of claim 8 wherein said means for covering the underarms of the fisherman comprises an anti-microbial fabric.

14. The shirt of claim 13 wherein said anti-microbial fabric comprises a first, inner layer that is hydrophilic combined in a plaited construction with a second, outer layer that is moisture absorbent in a plaited construction, said second, outer layer preferably comprising fibers that are either embedded with silver or copper sulfide or coated with silver or copper sulfide.

15. A garment comprising:

a body portion, said body portion being fabricated from a breathable fabric;

a yoke portion, said yoke portion being fabricated from a stretch fabric;

a pair of lower sleeve portions, each of said lower sleeve portions being fabricated from a hydrophobic fabric; and a pair of underarm portions, each of said underarm portions being fabricated from an anti-microbial fabric, wherein each of said fabrics is a knitted fabric, and wherein said anti-microbial fabric comprises a first, inner layer and a second, outer layer that is moisture absorbent, said second, outer layer preferably comprising fibers that are either embedded with silver or copper sulfide or coated with silver or copper sulfide.

* * * * *